US006111395A

United States Patent [19]

Hirade et al.

[11] Patent Number: 6,111,395

[45] Date of Patent: Aug. 29, 2000

[54] POWER SUPPLY VOLTAGE STEP-DOWN CIRCUITRY

[75] Inventors: Takuya Hirade; Masato Koura; Katsunobu Hongo, all of Tokyo, Japan

[73] Assignee: Mitsubishi Denki Kabushiki Kaisha, Tokyo, Japan

[21] Appl. No.: 09/436,245

[22] Filed: Nov. 9, 1999

[30] Foreign Application Priority Data

Jul. 7, 1999 [JP] Japan ..... 11-193449

[51] Int. Cl.[7] ..... G05F 1/445

[52] U.S. Cl. ..... 323/273

[58] Field of Search ..... 323/270, 271, 323/273, 274, 275; 363/62; 327/530, 535, 538, 540

[56] References Cited

U.S. PATENT DOCUMENTS

| | | | |
|---|---|---|---|
| 5,373,477 | 12/1994 | Sugibayashi | 365/26 |
| 5,408,172 | 4/1995 | Tamimoto et al. | 323/273 |
| 5,506,495 | 4/1996 | Uchida | 323/315 |
| 5,696,465 | 12/1997 | Ishzuka | 327/554 |

FOREIGN PATENT DOCUMENTS 8-211954 8/1996 Japan .

*Primary Examiner*—Matthew Nguyen
*Attorney, Agent, or Firm*—Burns, Doane, Swecker & Mathis, LLP

[57] ABSTRACT

Power supply voltage step-down circuitry comprises a control unit for enabling either a first voltage step-down unit or a second voltage step-down unit according to a control signal applied thereto, a voltage checking unit for checking whether or not the value of a voltage generated by a power supply is equal to or greater than a predetermined value, and for furnishing a checking result signal at a predetermined level when the value of the voltage generated by the power supply is equal to or greater than a predetermined value, and a switching unit for connecting either the power supply or an output of the first step-down unit with a receiver, such as a ROM, according to whether or not the checking result signal from the voltage checking unit is at the predetermined level. The voltage checking unit includes a Schmidt circuit that furnishes the checking result signal at a level corresponding to the value of an output of a checking unit for furnishing the output having a value corresponding to the power supply voltage.

10 Claims, 7 Drawing Sheets

POWER SUPPLY VOLTAGE STEP-DOWN CIRCUITRY

BACKGROUND OF THE INVENTION

1. Field of the Invention

The present invention relates to power supply voltage step-down circuitry for decreasing the voltage of a power supply and for supplying the decreased voltage to a receiver.

2. Description of the Prior Art

Referring now to FIG. 9, there is illustrated a schematic circuit diagram showing the structure of prior art power supply voltage step-down circuitry. In the figure, reference numeral 1 denotes a current supply circuit, numeral 2 denotes a pull-up circuit, numeral 3 denotes a circuit, such as a ROM, which is the receiver of power supply voltage generated by the prior art power supply voltage step-down circuitry, and numeral 4 denotes a control circuit. The circuit 3 will be referred to as a target circuit in this specification. Further, reference numeral 10 denotes a power supply, numeral 11 denotes a comparator, numeral 12 denotes a P-channel transistor having a source connected to the power supply 10, a drain connected to an output 13 of the current supply circuit 1, and a gate connected to an output of the comparator 11, numeral 21 denotes a resistor having an end connected to the power supply 10, and numeral 22 denotes a switch having an end connected to the other end of the resistor 21 and another end connected to a power supply 31 of the target circuit 3. The comparator 11 has an input to which a reference voltage is applied and another input connected to both the drain of the P-channel transistor 12 and the output 13 of the current supply circuit 1. The comparator 11 of the current supply circuit 1 has a control terminal 111 to receive a comparator enable signal from the control circuit 4. The power supply 10 is connected to the comparator 11 (the connection is not shown in FIG. 9). The switch 22 of the pull-up circuit 2 has a control terminal 221 to receive a pull-up circuit enable signal from the control circuit 4.

The power supply voltage step-down circuit, as shown in FIG. 9, can be incorporated into a microcomputer, for example, and serve to supply a 3-V power supply voltage to a ROM in order to activate the ROM together with a ROM peripheral circuit that can run from 5-V supply. In this case, the power supply voltage step-down circuit generates a 3-V power supply voltage by decreasing the output voltage of the power supply 10 and then supplies the 3-V power supply voltage to the ROM that can run from 3-V supply while the 5-V power supply 10 directly applies its output voltage to the ROM peripheral circuit that can run from 5-V supply.

In general, although prior art power supply voltage step-down circuitry can supply a decreased voltage having a certain value, which has been generated from the output of the power supply 10, to the target circuit 3 such as a ROM, the decreased voltage tends to decrease with an increase in the output current and to increase with a decrease in the output current. To eliminate the drawback, the prior art power supply voltage step-down circuitry can use a method of detecting changes in the decreased voltage, and increasing the decreased voltage with a decrease in the decreased voltage or further decreasing the decreased voltage with an increase in the decreased voltage. Using the method, the prior art power supply voltage step-down circuitry can supply a decreased voltage having a constant value.

Dividing the prior art power supply voltage step-down circuitry broadly into parts, the prior art power supply voltage step-down circuitry is comprised of the current supply circuit 1 and the pull-up circuit 2, as shown in FIG. 9. Either the output 13 of the current supply circuit 1 or the output 23 of the pull-up circuit 2 can be connected to the power supply 31 of the target circuit 3, such as a ROM, which runs from the decreased voltage from the prior art power supply voltage step-down circuitry. The current supply circuit 1 generates and furnishes the decreased voltage to the target circuit 3 when the target circuit 3 is held in a normal state. When the target circuit 3 is held in a normal state and the comparator 11 is enabled after the control circuit 4 has asserted and furnished the comparator enable signal to the control terminal 111 of the comparator 11, the current supply circuit 1 can keep its output 13 at a certain voltage. To be more specific, when the voltage of the output 13 of the current supply circuit 1 exceeds the reference voltage, the output of the comparator 11 increases in voltage. As a result, the P-channel transistor 12 switches to the off state and the voltage that appears at the drain of the P-channel transistor 12 drops, and therefore the voltage of the output 13 of the current supply circuit 1 drops. In contrast, when the voltage of the output 13 of the current supply circuit 1 becomes lower than the reference voltage, the output voltage of the comparator 11 drops. As a result, the P-channel transistor 12 switches to the on state and the voltage that appears at the drain of the P-channel transistor 12 increases, and therefore the output 13 of the current supply circuit 1 increases in voltage. This feedback control makes it possible for the current supply circuit 1 to keep its output 13 at a certain voltage by sensing any variation in the voltage of the output 13 and changing the output voltage back to its original value. Since the comparator 11 can give a quick response to changes in the input connected to the output 13, and therefore any variation in the input can quickly cause a change in the output of the comparator, the current supply circuit 1 can quickly correct the decreased voltage.

In this way, the current supply circuit 1 can supply a large amount of current to the target circuit 3 while, even if the decreased voltage applied to the target circuit 3 that consumes the current fed thereto from the current supply circuit 1 varies, the current supply circuit 1 can quickly correct the decreased voltage to prevent any variation in the decreased voltage. In contrast, the current supply circuit 1 has the disadvantage of high current consumption.

On the other hand, when the target circuit 3 is held in a standby state, the control circuit 4 negates the comparator enable signal, and therefore the comparator 11 furnishes an output having a voltage at a power supply voltage level. As a result, the P-channel transistor 12 is brought into a floating state and hence the output 13 of the current supply circuit 1 is also brought into a floating state.

The pull-up circuit 2 generates a decreased voltage when the current consumption in the target circuit 3 is very small, such as when the target circuit 3 is held in a standby state. When the target circuit 3 is held in a standby state, dissipation current flowing through the target circuit 3 is very small and few variations occur in the dissipation current. There can be a constant voltage drop due to the dissipation current flowing through the target circuit 3 in the resistor 21 of the pull-up circuit 2. As a result, the decreased voltage, which is obtained by subtracting the voltage drop from the voltage of the power supply 10, is supplied to the power supply 31 of the target circuit 3.

To be more specific, when the target circuit 3 is held in a standby state, the control circuit 4 asserts the pull-up circuit enable signal (at the same time, the comparator enable signal is negated). As a result, the power supply 10, the resistor 21, the switch 22, and the output 23 of the pull-up circuit are electrically connected to each other. Since the dissipation current flowing through the target circuit 3 is very small and is almost constant when the target circuit 3 is held in a standby state, a constant voltage drop occurs in the resistor 21 of the pull-up circuit 2 due to the dissipation current. As a result, a voltage that is equal to (the voltage of the power supply 10—the voltage drop) appears at the output 23 of the pull-up circuit and is then applied to the power supply 31 of the target circuit 3. Accordingly, by setting the resistance value of the resistor 21 so that the decreased voltage that appears at the output 23 of the pull-up circuit has a desired value, the prior art power supply voltage step-down circuitry can supply the decreased voltage having the desired value to the target circuit 3 even when the target circuit 3 is held in a standby state.

As shown in FIG. 9, the control circuit 4 has an output connected to both the control terminal 111 of the comparator 11 of the current supply circuit 1 and the control terminal 221 of the switch 22 of the pull-up circuit 2. When the target circuit 3 is held in a normal state, the control circuit 4 furnishes a signal at a power supply voltage level. In contrast, when the target circuit 3 is held in a standby state, the control circuit 4 furnishes a signal at a ground level. When the comparator enable signal is at a power supply voltage level, the comparator 11 of the current supply circuit 1 is enabled. When the pull-up circuit enable signal is at a ground level, the switch 22 of the pull-up circuit 2 is enabled. As previously mentioned, when the target circuit 3 is held in a normal state, the comparator 11 of the current supply circuit 1 is enabled. In contrast, when the target circuit 3 is held in a standby state, the switch 22 of the pull-up circuit 2 is closed. Referring next to FIG. 10, there is illustrated a schematic circuit diagram showing the structure of an example of the control circuit 4 of the prior art power supply voltage step-down circuitry. In the figure, reference numeral 41 denotes an inverter. As shown in FIG. 10, the control circuit 4 is constructed of the inverter 41 to receive a stop signal, and the output of the inverter 41 serves as the output of the control circuit 4. For example, when a microcomputer executes a stop instruction, the target circuit 3 is brought into a standby state. In this case, since the stop signal has a power supply voltage level and hence the output of the control circuit 4 has a ground level, the current supply circuit 1 is disabled and the pull-up circuit 2 is enabled.

A microcomputer into which the prior art power supply voltage step-down circuitry as mentioned above is incorporated uses the output 13 or 23 which has been obtained by decreasing the voltage of the power supply 10. Accordingly, a problem with the prior art power supply voltage step-down circuitry is that since, when the voltage of the power supply 10 is low, the power supply 31 of the target circuit 3 has a lower voltage, a margin of low-voltage operating conditions becomes small. To solve the problem, Japanese Patent Application Publication (KOKAI) No.8-211954 discloses power supply voltage step-down circuitry for directly using an external voltage as an internal voltage to be applied to a target circuit, such as a ROM, without having to use a voltage step-down circuit, when the external voltage is equal to or less than a reference voltage.

Referring next to FIG. 11, there is illustrated a schematic circuit diagram showing the prior art power supply voltage step-down circuitry as disclosed in Japanese Patent Application Publication (KOKAI) No. 8-211954. In the figure, reference numeral 10 denotes a power supply, numeral 31 denotes a P-channel transistor, numeral 32 denotes a voltage checking circuit for sensing the voltage of the power supply 10 and for comparing the sensed voltage with a reference voltage, numerals 33 and 34 denote transmission gates, numeral 35 denotes a voltage step-down circuit for decreasing the voltage of the power supply 10 and for furnishing the decreased voltage, and 36 denotes a control circuit for disabling the voltage step-down circuit 35 when the voltage of the power supply 10 is lower than the reference voltage.

In operation, the voltage checking circuit 32 having a 4-V threshold voltage (or reference voltage) senses the voltage of the power supply 10 when the voltage step-down circuit 35 and the P-channel transistor 31 decrease the voltage of the power supply 10 which can vary in the range of 0 to 5 volts to generate a 3-V internal voltage Vint. When the voltage of the power supply 10 is equal to or less than 4 volts, the voltage checking circuit 32 applies its output to the P-channel transistor 31 by way of the transmission gate 33 to control the P-channel transistor 31. In this case, the P-channel transistor 31 is brought into the on state, and therefore the voltage of the power supply 10, which is the source voltage, becomes Vint. In contrast, when the voltage of the power supply 10 exceeds 4 volts, the voltage step-down circuit 35 applies its output to the P-channel transistor 31 by way of the transmission gate 34. In this case, a decreased voltage from the voltage step-down circuit 35 becomes Vint. Therefore, the prior art power supply voltage step-down circuitry, as shown in FIG. 11, has a disadvantage in that when the voltage of the power supply 10 has a value which is close to the 4-V threshold voltage, the internal voltage Vint becomes unstable. In addition, since the voltage checking circuit disposed within the prior art power supply voltage step-down circuitry checks whether the voltage of the power supply exceeds the threshold voltage at all times, the current consumption in the prior art power supply voltage step-down circuitry is large.

SUMMARY OF THE INVENTION

The present invention is made to overcome the above problem. It is therefore an object of the present invention to provide power supply voltage step-down circuitry capable of supplying a stable output using a power supply even though the power supply has a voltage which is close to a threshold voltage of a voltage checking circuit for checking whether the voltage of the power supply exceeds the threshold voltage.

It is another object of the present invention to provide power supply voltage step-down circuitry with a small current consumption.

In accordance with one aspect of the present invention, there is provided power supply voltage step-down circuitry comprising: a first voltage step-down unit for generating a first voltage from a power supply, the first voltage having a value less than that of a voltage generated by the power supply, and for controlling the value of the first voltage by comparing the first voltage with a reference voltage, to supply the first voltage to a receiver; a second voltage step-down unit for generating a second voltage from the power supply, the second voltage having a value less than that of the voltage generated by the power supply, and for supplying the second voltage to the receiver; a control unit for enabling either the first voltage step-down unit or the second voltage step-down unit according to a control signal applied thereto; a voltage checking unit for checking whether or not the value of the voltage generated by the power supply is equal to or greater than a predetermined value, and for furnishing a checking result signal at a predetermined level when the value of the voltage generated by the power supply is equal to or greater than a predetermined value; a switching unit for connecting either the power supply or an output of the first step-down unit with the receiver according to whether or not the checking result signal from the voltage checking unit is at the predetermined level; and the voltage checking unit including a Schmidt circuit provided with a checking section for furnishing an output having a value corresponding to the value of the voltage of the power supply, a first inverter for receiving and inverting the output of the checking section, a second inverter having an input connected to an output of the first inverter and an output connected to an input of the first inverter, and a third inverter that has an input connected to the output of the first inverter and inverts the output of the first inverter, the Schmidt circuit furnishing the checking result signal at a level corresponding to the value of the output of the checking section.

In accordance with a preferred embodiment of the present invention, the checking section of the voltage checking unit is enabled only when the control unit furnishes an output having a predetermined value so as to enable either the first voltage step-down unit or the second voltage step-down unit.

Preferably, the checking section includes at least a resistor, and a transistor having a first terminal connected to the power supply by way of the resistor, a second terminal connected to a ground, and a gate terminal connected to the output of the control unit. The checking section can furnish an output to the Schmidt circuit by way of a connecting point between the resistor and the first terminal of the transistor.

In accordance with another preferred embodiment of the present invention, the checking section includes two resistors in series, and furnishes an output to the Schmidt circuit by way of a connecting point between the two resistors.

In accordance with another preferred embodiment of the present invention, the voltage checking unit includes a timer unit for allowing the control unit to furnish its output to the checking section at predetermined intervals, and a latch circuit for latching and holding an output of the Schmidt circuit at the predetermined intervals, and for furnishing the latched output of the Schmidt circuit as the checking result signal.

Preferably, the switching unit connects the output of the first step-down unit with the receiver when the checking result signal from the voltage checking unit is at the predetermined level, or directly connects the power supply with the receiver otherwise.

Further objects and advantages of the present invention will be apparent from the following description of the preferred embodiments of the invention as illustrated in the accompanying drawings.

DETAILED DESCRIPTION OF THE PREFERRED EMBODIMENTS

First Embodiment

Figure 1:
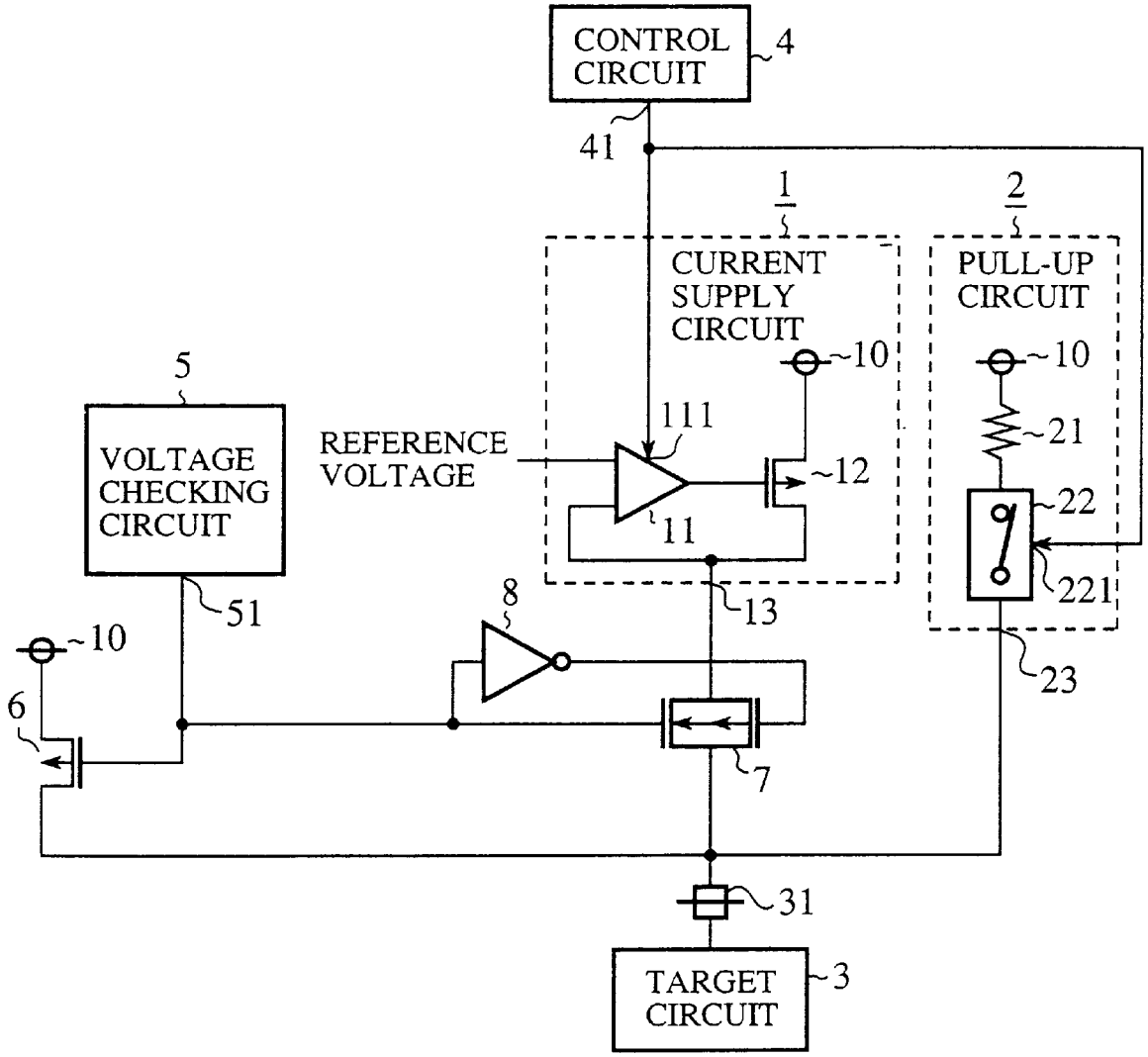
FIG. 1 is a schematic circuit diagram showing the structure of power supply voltage step-down circuitry according to a first embodiment of the present invention.

Referring next to FIG. 1, there is illustrated a block diagram showing the structure of power supply voltage step-down circuitry according to a first embodiment of the present invention. In the figure, reference numeral 1 denotes a current supply circuit, numeral 2 denotes a pull-up circuit, numeral 3 denotes a target circuit, such as a ROM, which is the receiver of a power supply voltage from the power supply voltage step-down circuitry, numeral 4 denotes a control circuit, numeral 5 denotes a voltage checking circuit for determining whether the power supply voltage step-down circuitry uses either a power supply 10 or an output 13 or 23 whose voltage has dropped from that of the power supply 10, which has been generated by either the current supply circuit 1 or the pull-up circuit 2, according to the voltage of the power supply 10, numeral 6 denotes a P-channel transistor having a source connected to the power supply 10, a drain connected to the power supply 31 of the target circuit 3, and a gate connected to an output 51 of the voltage checking circuit 5, and numeral 7 denotes a transmission gate that is on-off controlled by both the output 51 of the voltage checking circuit 5 and an output of an inverter 8 to invert the output 51, for either connecting or disconnecting the output 13 of the current supply circuit 1 with or from the power supply 31 of the target circuit 3. In addition, reference numeral 11 denotes a comparator, numeral 12 denotes a P-channel transistor having a source connected to the power supply 10, a drain connected to the output 13, and a gate connected to an output of the comparator 11, numeral 21 denotes a resistor having an end connected to the power supply 10, and numeral 22 denotes a switch having an end connected to the other end of the resistor 21 and another end connected to the power supply 31 of the target circuit 3. The comparator 11 has an input to which a reference voltage is applied and another input connected to both the drain of the P-channel transistor 12 and the output 13 of the current supply circuit 1. The comparator 11 of the current supply circuit 1 has a control terminal 111 to receive a comparator enable signal from the control circuit 4. The power supply 10 is connected to the comparator 11 (the connection is not shown in FIG. 1). The switch 22 of the pull-up circuit 2 has a control terminal 221 to receive a pull-up circuit enable signal from the control circuit 4.

Figure 2:
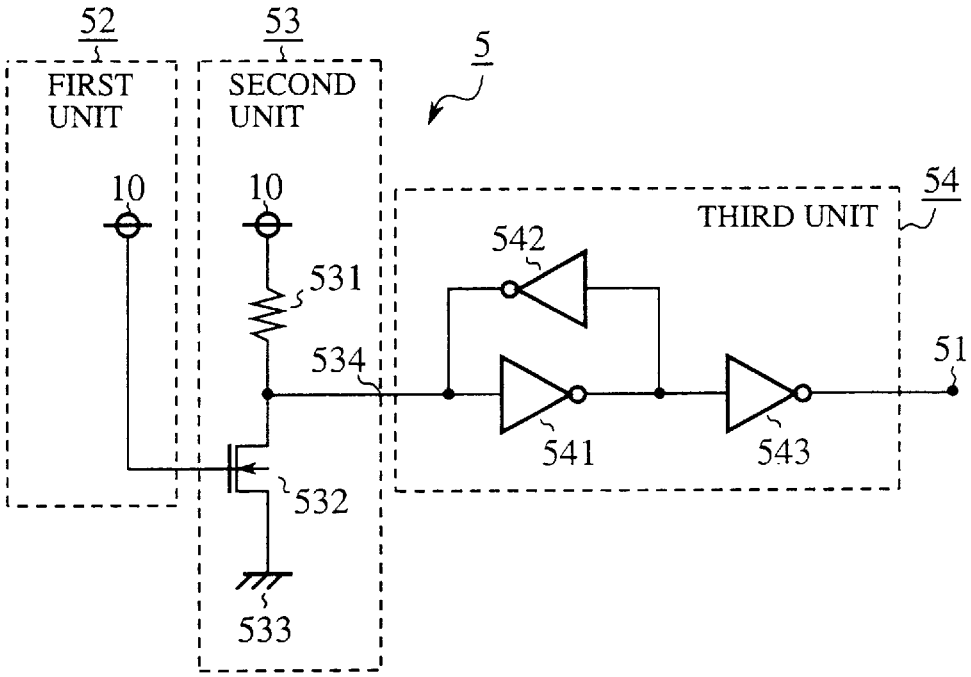
FIG. 2 is a schematic circuit diagram showing the structure of an example of a voltage checking circuit of the power supply voltage step-down circuitry according to the first embodiment of the present invention.

Referring next to FIG. 2, there is illustrated a schematic circuit diagram showing the structure of the voltage checking circuit 5 of the power supply voltage step-down circuitry according to the first embodiment of the present invention. In the figure, reference numeral 52 denotes a first unit of the voltage checking circuit 5, which is comprised of the power supply 10, 53 denotes a second unit of the voltage checking circuit 5, which is comprised of the power supply 10, a resistor 531 having an end connected to the power supply 10, and an N-channel transistor 532 having a drain connected to the other end of the resistor 531, a source connected to a ground 533, and a gate connected to the power supply 10 of the first unit 52, and 54 denotes a third unit of the voltage checking circuit 5, which is comprised of a first inverter 541 that has an input connected to an output 534 of the second unit 53 and inverts the output 534 of the second unit 53, a second inverter 542 having an input connected to an output of the first inverter 541 and an output connected to the input of the first inverter 541, and a third inverter 543 that has an input connected to the output of the first inverter 541 and an output connected to the output 51 of the voltage checking circuit 5, and inverts the output of the first inverter 541. The third unit 54 is a so-called Schmidt circuit.

The power supply voltage step-down circuitry of the present embodiment, as shown in FIG. 1, can be incorporated into a microcomputer, for example, and serve to supply a 3-V power supply voltage to a ROM in order to activate the ROM together with a ROM peripheral circuit that can run from 5-V supply. In this case, the power supply voltage step-down circuitry generates a 3-V power supply voltage by decreasing the output voltage of the power supply 10 and then supplies the 3-V power supply voltage to the ROM that can run from 3-V supply while the 5-V power supply 10 directly applies its output voltage to the ROM peripheral circuit that can run from 5-V supply.

The current supply circuit 1 generates and supplies a decreased voltage to the target circuit 3 such as a ROM when the target circuit 3 operates normally. When the target circuit 3 is held in a normal state and the comparator 11 is enabled after the control circuit 4 has asserted and furnished the comparator enable signal to the control terminal 111 of the comparator 11, the current supply circuit 1 can keep its output 13 at a certain voltage. To be more specific, when the voltage of the output 13 of the current supply circuit 1 exceeds the reference voltage, the output of the comparator 11 increases in voltage. As a result, the P-channel transistor 12 switches to the off state and the voltage that appears at the drain of the P-channel transistor 12 drops, and therefore the voltage of the output 13 of the current supply circuit 1 drops. In contrast, when the voltage of the output 13 of the current supply circuit 1 becomes lower than the reference voltage, the output voltage of the comparator 11 drops. As a result, the P-channel transistor 12 switches to the on state and the voltage that appears at the drain of the P-channel transistor 12 increases, and therefore the output 13 of the current supply circuit 1 increases in voltage. This feedback control makes it possible for the current supply circuit 1 to keep its output 13 at a certain voltage by sensing any variation in the voltage of the output 13 and changing the output voltage back to its original value. Since the comparator 11 can give a quick response to changes in the input connected to the output 13 and therefore any variation in the input can quickly cause a change in the output of the comparator, the current supply circuit 1 can quickly correct the decreased voltage.

In this way, the current supply circuit 1 can supply a large amount of current to the target circuit 3 while, if the decreased voltage applied to the target circuit 3 that consumes the current fed thereto from the current supply circuit 1 varies, the current supply circuit 1 can quickly correct the decreased voltage to prevent any variation in the decreased voltage. In contrast, the current supply circuit 1 has the disadvantage of high current consumption.

On the other hand, when the target circuit 3 is held in a standby state, the control circuit 4 negates the comparator enable signal, and therefore the comparator 11 furnishes an output having a voltage at a power supply voltage level. As a result, the P-channel transistor 12 is brought into a floating state and hence the output 13 of the current supply circuit 1 is also brought into a floating state.

The pull-up circuit 2 generates a decreased voltage when the current consumption in the target circuit 3 is very small, such as when the target circuit 3 is held in a standby state. When the target circuit 3 is held in a standby state, dissipation current flowing through the target circuit 3 is very small and few variations occur in the dissipation current. There can be a constant voltage drop due to the dissipation current flowing through the target circuit 3 in the resistor 21 of the pull-up circuit 2. As a result, the decreased voltage, which is obtained by subtracting the voltage drop from the voltage of the power supply 10, is supplied to the power supply 31 of the target circuit 3.

To be more specific, when the target circuit 3 is held in a standby state, the control circuit 4 asserts the pull-up circuit enable signal (at the same time, the comparator enable signal is negated). As a result, the power supply 10, the resistor 21, the switch 22, and the output 23 of the pull-up circuit are electrically connected to each other. Since the dissipation current flowing through the target circuit 3 is very small and is almost constant when the target circuit 3 is held in a standby state, a constant voltage drop occurs in the resistor 21 of the pull-up circuit 2 due to the dissipation current. As a result, a voltage that is equal to (the voltage of the power supply 10—the voltage drop) appears at the output 23 of the pull-up circuit and is then applied to the power supply 31 of the target circuit 3. Accordingly, by setting the resistance value of the resistor 21 so that the decreased voltage that appears at the output 23 of the pull-up circuit has a desired value, the power supply voltage step-down circuitry of the present embodiment can supply the decreased voltage having the desired value to the target circuit 3 even when the target circuit 3 is held in a standby state.

Figure 9:
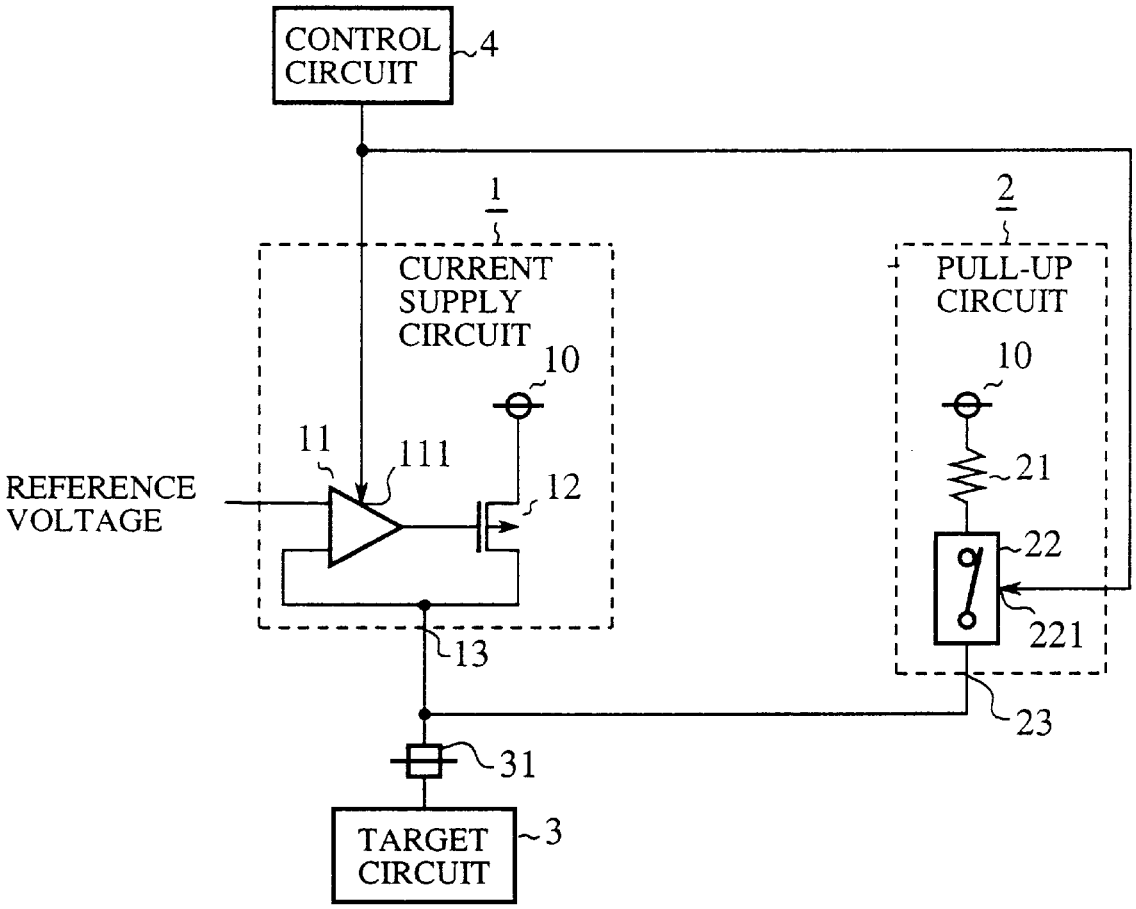
FIG.9 (PRIOR ART)
FIG. 9 is a schematic circuit diagram showing the structure of prior art power supply voltage step-down circuitry.
Figure 10:
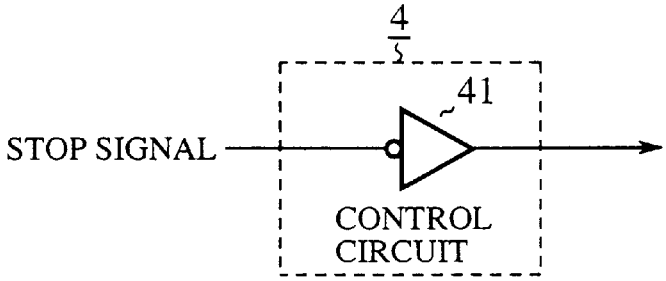
FIG. 10 is a schematic circuit diagram showing the structure of an example of a voltage checking circuit of the prior art power supply voltage step-down circuitry of FIG. 9.
Figure 11:
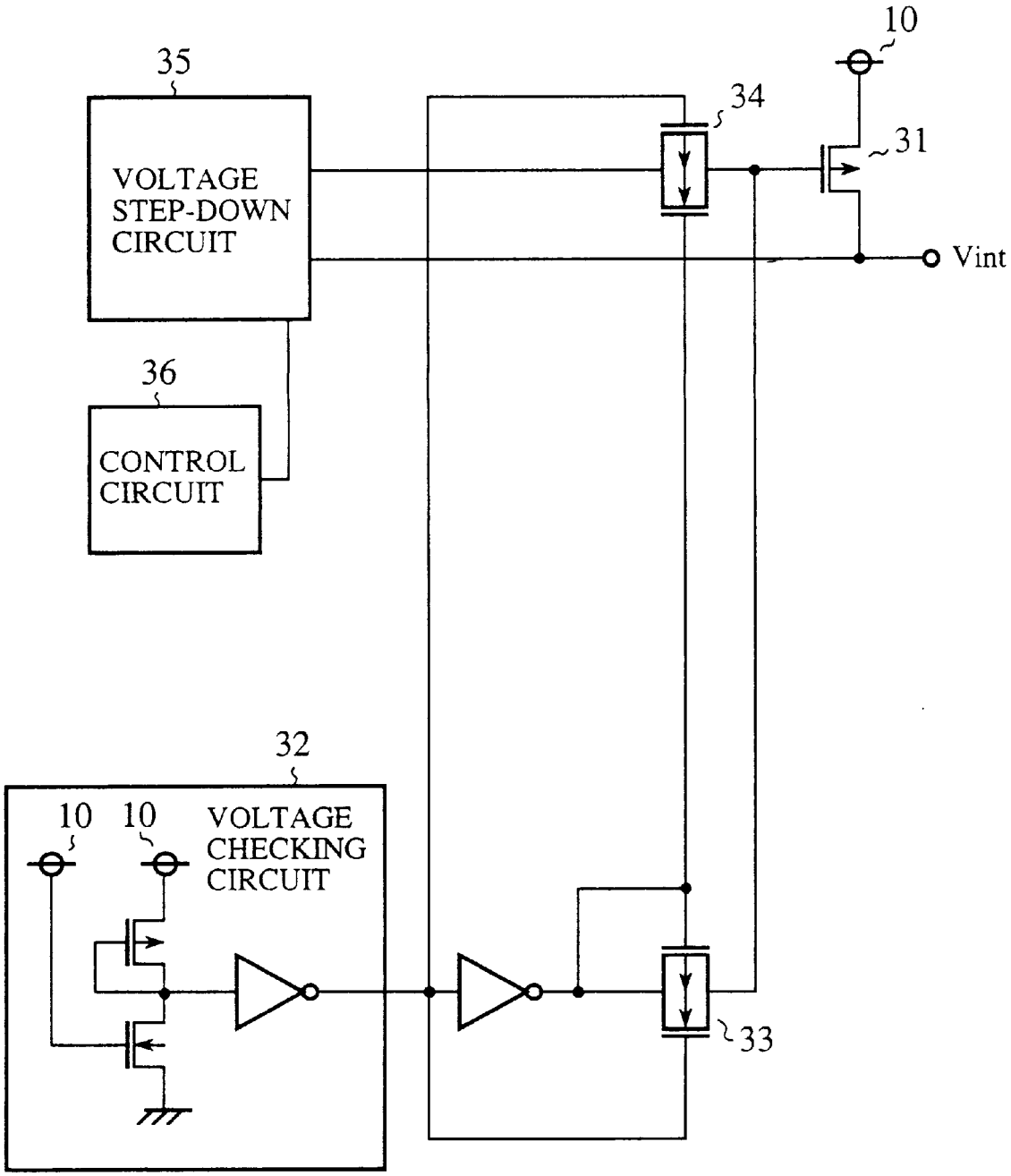
FIG.11 (PRIOR ART)
FIG. 11 is a schematic circuit diagram showing the structure of other prior art power supply voltage step-down circuitry.

As shown in FIG. 1, the control circuit 4 has an output connected to both the control terminal 111 of the comparator 11 of the current supply circuit 1 and the control terminal 221 of the switch 22 of the pull-up circuit 2. When the target circuit 3 is held in a normal state, the control circuit 4 furnishes a signal at a power supply voltage level. In contrast, when the target circuit 3 is held in a standby state, the control circuit 4 furnishes a signal at a ground level. When the comparator enable signal is at a power supply voltage level, the comparator 11 of the current supply circuit 1 is enabled. When the pull-up circuit enable signal is at a ground level, the switch 22 of the pull-up circuit 2 is enabled. As previously mentioned, when the target circuit 3 is held in a normal state, the comparator 11 of the current supply circuit 1 is enabled. In contrast, when the target circuit 3 is held in a standby state, the switch 22 of the pull-up circuit 2 is closed. The control circuit 4 of the power supply voltage step-down circuitry according to the first embodiment can have the same structure as the prior art power supply voltage step-down circuitry as shown in FIG. 9. When a microcomputer, into which the power supply voltage step-down circuitry is incorporated, executes a stop instruction, for example, the target circuit 3 is brought into a standby state. In this case, since a stop signal applied to the control circuit 4 has a power supply voltage level and hence the output of the control circuit 4 has a ground level, the current supply circuit 1 is disabled and the pull-up circuit 2 is enabled.

The voltage checking circuit 5 connects either the power supply 10 or the output 13 or 23 whose voltage has been decreased by the current supply circuit 1 or the pull-up circuit 2 with the power supply 31 of the target circuit 3, according to the voltage of the power supply 10. The voltage checking circuit 5 furnishes the output 51 at a power supply voltage level when the voltage of the power supply 10 is relatively high and the output 13 or 23 of the current supply circuit 1 or pull-up circuit 2 is suitable for use as the power supply 31 of the target circuit 3. In contrast, the voltage checking circuit 5 furnishes the output 51 at a ground level when the voltage of the power supply 10 is relatively low and the use of the output 13 or 23 of the current supply circuit 1 or pull-up circuit 2 as the power supply 31 of the target circuit 3 cannot ensure a margin of operating conditions of the target circuit 3 because the voltage of the power supply 31 of the target circuit is low.

Figure 3:
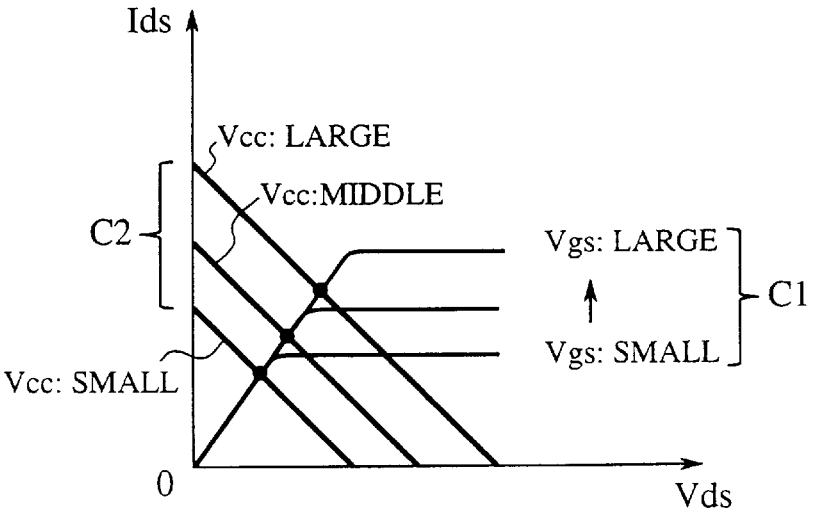
FIG. 3 is a graph showing the voltage of an output of a second unit of the voltage checking circuit of FIG. 2 when an N-channel transistor included in the second unit is held in the on state.

To be more specific, in the voltage checking circuit 5, the N-channel transistor 532 of the second unit 53 is held in the on state at all times because the gate of the N-channel transistor 532 is directly connected to the power supply 10, as shown in FIG. 2. The N-channel transistor 532 has a characteristic as shown in FIG. 3 when it is held in the on state. In FIG. 3, a curved line C1 shows a drain to source voltage Vds-drain to source current Ids characteristic of the N-channel transistor 532, depending on the gate to source voltage Vgs, and a line C2 shows an equation Ids=−Vds/R+Vcc, where R is the resistance value of the resistor 531, representing a relation among the voltage Vcc of the power supply 10, the drain to source voltage Vds, and the drain to source current Ids. A point of intersection of the curved line C1 and the line C2 represents a through current flowing from the power supply 10 of the second unit 53 to the ground 533, and the voltage of the output 534. As can be seen from FIG. 3, the voltage of the output 534 decreases with a decrease in the voltage Vcc of the power supply 10. When the voltage of the output 534 becomes lower than the threshold value of the first inverter 541, the first inverter 541 furnishes a signal at a power supply voltage level. As a result, the third inverter 543 that receives the signal from the first inverter furnishes a signal at a ground level. The voltage checking circuit 5 can thus check the voltage of the power supply 10 using the simple circuit structure as shown in FIG. 2.

In this way, the voltage checking circuit 5 furnishes the output 51 at a power supply voltage level when the voltage of the power supply 10 is relatively high and the output 13 or 23 of the current supply circuit 1 or pull-up circuit 2 is suitable for use as the power supply 31 of the target circuit 3. In contrast, the voltage checking circuit 5 furnishes the output 51 at a ground level when the voltage of the power supply 10 is relatively low and the use of the output 13 or 23 of the current supply circuit 1 or pull-up circuit 2 as the power supply 31 of the target circuit 3 cannot ensure a margin of operating conditions of the target circuit 3. To that end, the threshold value of the first inverter 541 has to be set so that the first inverter 541 furnishes a signal at a ground level when the output 534 of the second unit 53 indicates that the voltage of the power supply 10 is large enough to use either the output 13 of the current supply circuit 1 or the output 23 of the pull-up circuit 2 as the power supply 31 of the target circuit 3, and the first inverter 541 furnishes a signal at a power supply voltage level when the output 534 of the second unit 53 indicates that the voltage of the power supply 10 is too small to use either the output 13 of the current supply circuit 1 or the output 23 of the pull-up circuit 2 as the power supply 31 of the target circuit 3.

Figure 4:
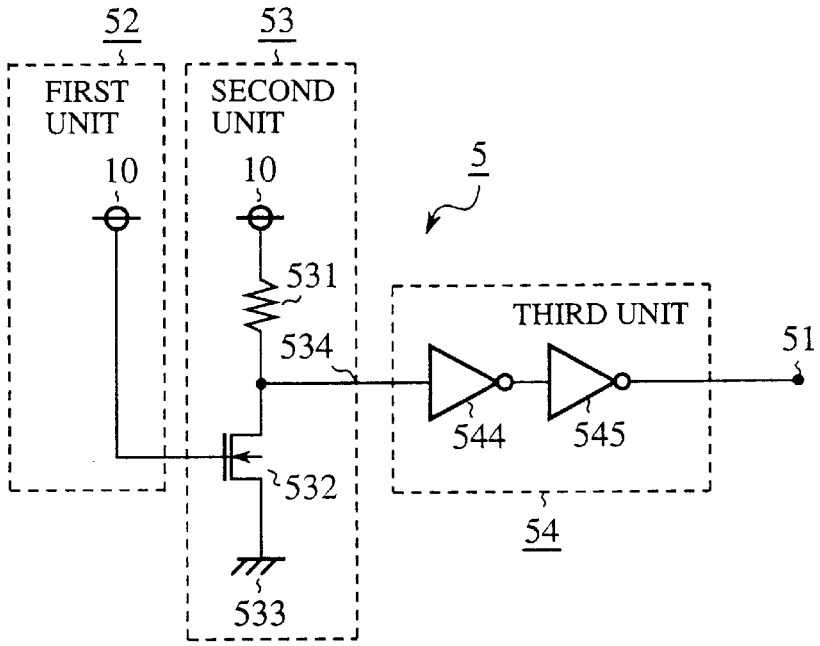
FIG. 4 is a schematic circuit diagram showing the structure of another example of the voltage checking circuit, for comparison with the voltage checking circuit of FIG. 2.

The third unit 54 of the voltage checking unit 5 can have a structure as shown in FIG. 4. However, when the third unit 54 is so structured, on-off switching occurs frequently in the first inverter 541 when the output 534 of the second unit 53 has a voltage which is close to the threshold value of the first inverter 541. In contrast, since the third unit 54 of the voltage checking circuit 5 of the first embodiment is constructed of a Schmidt circuit, as shown in FIG. 2, it has a hysteresis on/off characteristic. The voltage checking circuit 5 of the first embodiment can thus stabilize the output 51 because on/off switching does not frequently occur in the first inverter 541 even when the output 534 of the second unit 53 has a value which is close to the threshold value of the first inverter 541. As a result, the power supply voltage step-down circuitry according to the first embodiment can supply the stable output to the power supply 31 of the target circuit 3.

As previously mentioned, in accordance with the first embodiment of the present invention, the power supply voltage step-down circuitry can supply a stable output to the power supply 31 of the target circuit 3 in addition to connecting either the power supply or the output 13 or 23 of the current supply circuit 1 or pull-up circuit 2 with the power supply 31 of the target circuit 3, according to the voltage of the power supply 10.

Second Embodiment

Figure 5:
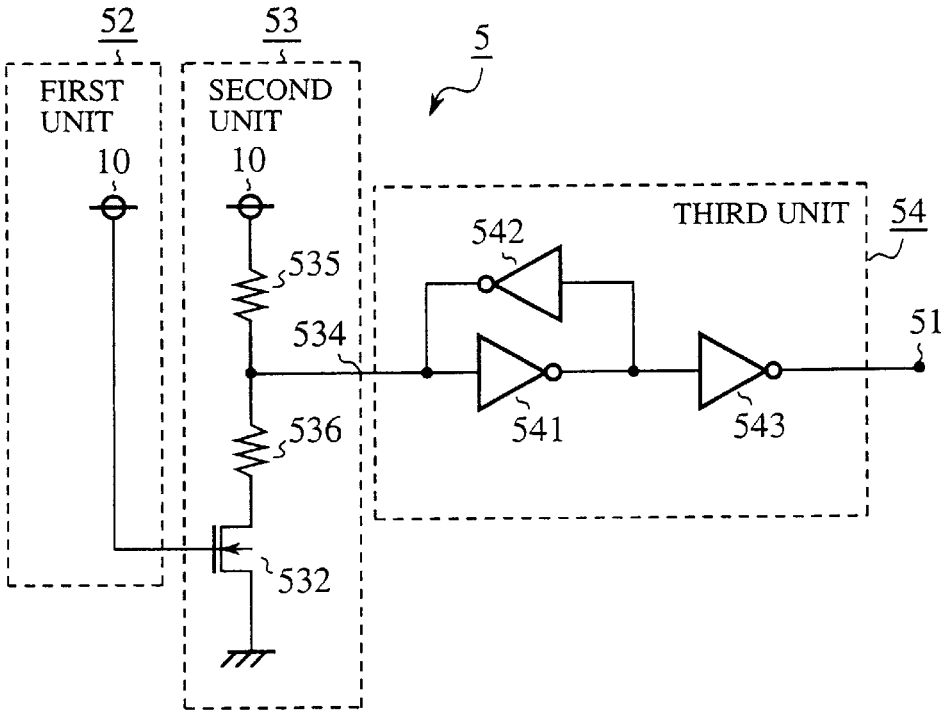
FIG. 5 is a schematic circuit diagram showing the structure of an example of a voltage checking circuit of power supply voltage step-down circuitry according to a second embodiment of the present invention.

Referring next to FIG. 5, there is illustrated a schematic circuit diagram showing the structure of a voltage checking circuit 5 of power supply voltage step-down circuitry according to a second embodiment of the present invention. In the figure, the same reference numerals as shown in FIG. 2 designate the same components as those of the voltage checking circuit 5 of the power supply voltage step-down circuitry according to the aforementioned first embodiment, or like components, and therefore the description of the components will be omitted hereinafter. In FIG. 5, reference numeral 535 denotes a resistor having an end connected to a power supply 10 and another end connected to an output 534, and numeral 536 denotes a resistor having an end connected to the output 534 and the resistor 535, and another end connected to the drain of an N-channel transistor 532.

In the second unit 53 of the voltage checking circuit 5 according to the aforementioned first embodiment as shown in FIG. 2, the voltage of the output 534, i.e., the drain to source voltage Vds of the N-channel transistor 532 changes greatly from its setting when the resistance value of the resistor 531 varies due to a factor associated with processes of manufacturing the power supply voltage step-down circuitry.

Figure 6:
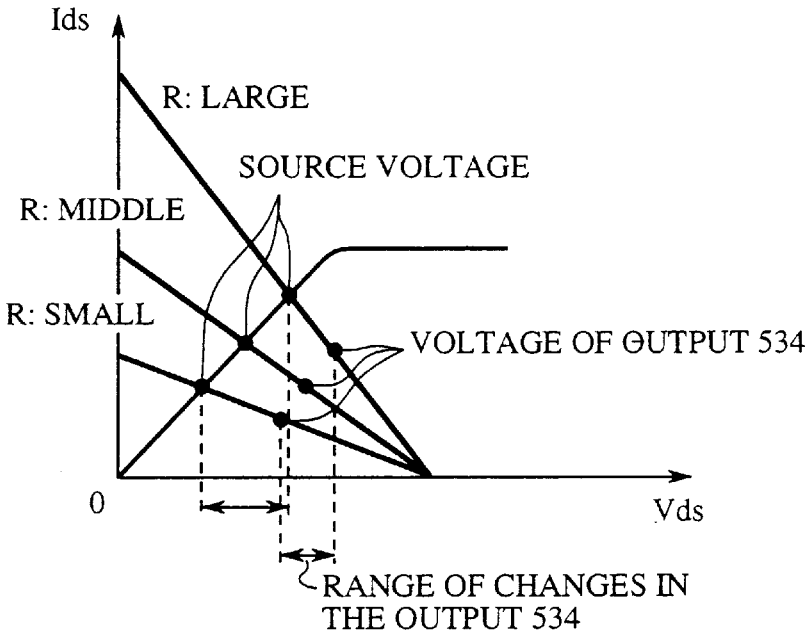
FIG. 6 is a graph showing the voltage of an output of a second unit of the voltage checking circuit of FIG. 5 when an N-channel transistor included in the second unit is held in the on state.

In contrast, in a second unit 53 of the voltage checking circuit 5 of the power supply voltage step-down circuitry according to the second embodiment, since a connecting point between the two resistors 535 and 536 is connected to the output 534, changes in the voltage of the output 534 are small even if the resistance values of the two resistors vary. As shown in FIG. 6, the drain to source voltage Vds of the N-channel transistor 532 varies with changes in the resistance values of the two resistors 535 and 536. The voltage of the output 534 rises from Vds by the voltage drop caused by the resistor 536. The smaller Vds, the larger the amount of increase in the output voltage. Therefore, changes in the voltage of the output 534 due to changes in the resistor values are small as compared with variations that can occur in the first embodiment, and therefore the output 51 can be further stabilized.

Third Embodiment

Figure 7:
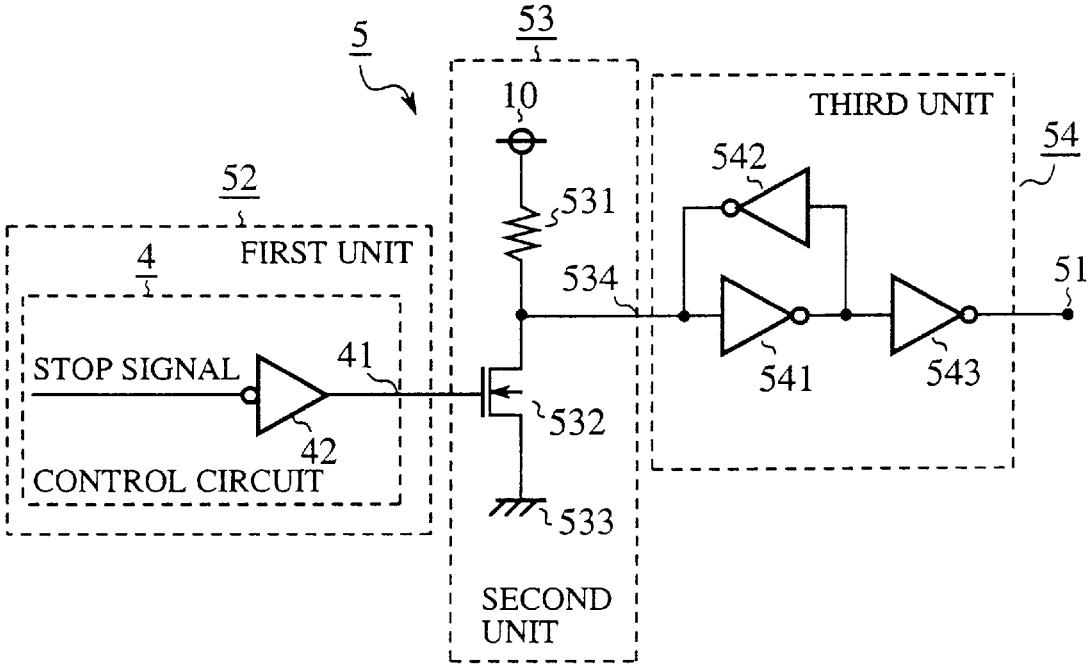
FIG. 7 is a schematic circuit diagram showing the structure of an example of a voltage checking circuit of power supply voltage step-down circuitry according to a third embodiment of the present invention.

Referring next to FIG. 7, there is illustrated a schematic circuit diagram showing the structure of a voltage checking circuit 5 of power supply voltage step-down circuitry according to a third embodiment of the present invention. As shown in FIG. 7, while the voltage checking circuit 5 of the power supply voltage step-down circuitry according to the third embodiment of the present invention includes first to third units 52 to 54, like the voltage checking circuit 5 of the power supply voltage step-down circuitry according to the aforementioned first embodiment of the present invention, the voltage checking circuit 5 of the third embodiment differs from the voltage checking circuit 5 of the first embodiment in that the first unit 52 is constructed of a control circuit 4 as shown in FIG. 1. The other structure of the power supply voltage step-down circuitry of the third embodiment is the same as that of the power supply voltage step-down circuitry according to the aforementioned first embodiment, and therefore the description of the other structure will be omitted hereinafter.

In the second unit 53 of the voltage checking circuit 5 of the power supply voltage step-down circuitry according to the aforementioned first embodiment, a through current flows from the power supply 10 to the ground 533 at all times because the N-channel transistor 532 is held at the on state at all times, as shown in FIG. 2. As a result, the second unit 53 of the voltage checking circuit 5 consumes the through current flowing therethrough at all times.

In contrast, since the first unit 52 of the voltage checking circuit 5 according to the third embodiment consists of the control circuit 4, the output 41 of an inverter 42, i.e., the output of the first unit 52 makes a high to low transition when a stop signal applied to the control circuit 4 becomes a power supply voltage level. When the voltage checking circuit 5 does not need to perform the voltage checking operation, that is, when a current supply circuit 1 is not used, such as when a microcomputer, into which the power supply voltage step-down circuitry is incorporated, executes a stop instruction or when a target circuit 3 is held in a standby state, the stop signal becomes a power supply voltage level and therefore the N-channel transistor 532 is turned off. As a result, the second unit 53 of the voltage checking circuit 5 does not consume the through current when the voltage checking circuit 5 does not need to perform the voltage checking operation.

The structure of the first unit 52 of the voltage checking circuit 5 is not limited to the one as shown in FIG. 7. The first unit 52 of the voltage checking circuit 5 can have any structure if it can bring the N-channel transistor 532 of the second unit 53 into the off state when the voltage checking circuit 5 does not need to perform the voltage checking operation.

As previously mentioned, in accordance with the third embodiment of the present invention, since the voltage checking circuit 5 can bring the N-channel transistor 532 of the second unit 53 into the off state when the voltage checking circuit 5 does not need to perform the voltage checking operation, it can reduce the current consumption due to the through current flowing through the second unit 53.

Fourth Embodiment

Figure 8:
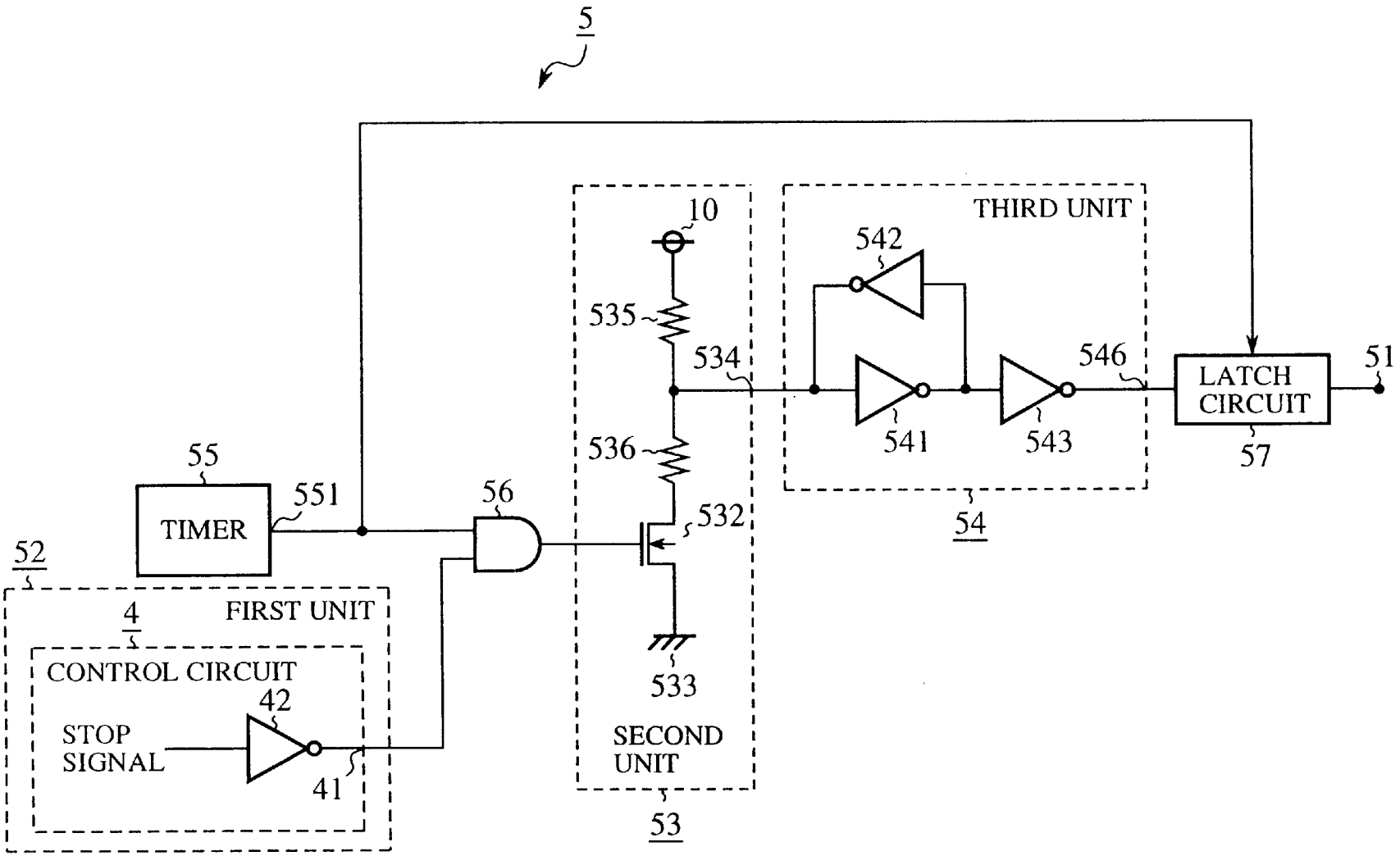
FIG. 8 is a schematic circuit diagram showing the structure of an example of a voltage checking circuit of power supply voltage step-down circuitry according to a fourth embodiment of the present invention.

Referring next to FIG. 8, there is illustrated a schematic circuit diagram showing the structure of a voltage checking circuit 5 of power supply voltage step-down circuitry according to a fourth embodiment of the present invention. In the figure, reference numeral 55 denotes a timer that measures a fixed period of time, furnishes an output 551 at a power supply voltage level every time it overflows, and, after that, is reset to restart measuring another fixed period of time having the same length as the previous time period, numeral 56 denotes an AND gate that receives the output 551 of the timer 55 and an output 41 of a first unit 52, then implements the logical AND operation on the two inputs, and furnishes the logical AND operation result to the gate of an N-channel transistor 532 of a second unit 53, and 57 denotes a latch circuit that latches an output 546 of a third unit 54 every time the timer 55 overflows. In FIG. 8, the same reference numerals as shown in FIG. 7 designate the same components as those of the voltage checking circuit 5 of the power supply voltage step-down circuitry according to the aforementioned third embodiment, and therefore the description of the components will be omitted hereinafter.

In the second unit 53 of the voltage checking circuit 5 of the power supply voltage step-down circuitry according to the aforementioned first embodiment, a through current flows from the power supply 10 to the ground 533 at all times because the N-channel transistor 532 is held at the on state at all times, as shown in FIG. 2. As a result, the second unit 53 of the voltage checking circuit 5 consumes the through current flowing therethrough at all times. In the power supply voltage step-down circuitry according to the aforementioned third embodiment, since the first unit 52 of the voltage checking circuit 5 is constructed of the control circuit 4, as shown in FIG. 7, the N-channel transistor 532 of the second unit 53 is held at the on state at all times when the stop signal applied to the control circuit 4 is at a ground level. As a result, the second unit 53 of the voltage checking circuit 5 consumes the through current flowing therethrough at all times.

The output voltage of the power supply does not change abruptly. The voltage checking circuit thus does not need to perform the voltage checking operation at all times. The voltage checking circuit 5 of the power supply voltage step-down circuitry according to the fourth embodiment can perform the voltage checking operation on the power supply 10 at fixed intervals, thus reducing the current consumption due to the through current flowing through the second unit 53.

Since the first unit 52 of the voltage checking circuit 5 according to the fourth embodiment consists of a control circuit 4, like the voltage checking circuit of the aforementioned third embodiment, the output 41 of an inverter 42, i.e., the output of the first unit 52 makes a high to low transition when a stop signal applied to the control circuit 4 becomes a power supply voltage level. When the voltage checking circuit 5 does not need to perform the voltage checking operation, that is, when a current supply circuit 1 is not used, such as when a microcomputer, into which the power supply voltage step-down circuitry is incorporated, executes a stop instruction or when a target circuit 3 is held in a standby state, the stop signal becomes a power supply voltage level and therefore the output of the inverter 41 becomes a ground level. The output of the AND gate 56 thus becomes a ground level regardless of the output of the timer 55, and the N-channel transistor 532 of the second unit 53 is then turned off. As a result, the second unit 53 of the voltage checking circuit 5 does not consume the through current when the voltage checking circuit 5 does not need to perform the voltage checking operation.

On the other hand, every time the timer 55 is reset, it puts its output at a ground level and restarts measuring a fixed period of time. While the output of the timer 55 is at a ground level, the N-channel transistor 532 of the second unit 53 is held in the off state because the output of the AND gate 56 is at a ground level even if the stop signal is at a ground level and hence the output of the inverter 41 is at a power supply voltage level. After that, when the timer 55 finishes measuring the fixed period of time and overflows, it puts its output at a power supply voltage level. At that time, when the stop signal is at a ground level and hence the output of the inverter 41 is at a power supply voltage level, the output of the AND gate 56 becomes a power supply voltage level and the N-channel transistor 532 of the second unit 53 is therefore turned on. The second and third units 53 and 54 of the voltage checking circuit 5 perform the voltage checking operation on the power supply 10 and then furnishes an output 546 having a value corresponding to the value of the power supply voltage to the latch circuit 57. The latch circuit 57 is enabled in response to the output 551 at a power supply voltage level from the timer 55, and then latches the output 546 of the third unit 54 and furnishes the latched output as the output signal 51 of the voltage checking circuit 5.

In this way, the voltage checking circuit of the fourth embodiment performs the voltage checking operation by bringing the N-channel transistor 532 of the second unit 53 into the on state immediately after the timer finishes measuring every fixed period of time and then overflows. Simultaneously, the latch circuit 57 is activated, and then latches and holds the output signal 546 of the third unit 54. The latch circuit 57 furnishes the latched output as the output signal 51. After that, the timer 55 is reset to restart measuring another fixed period of time having the same length as the previous time period and put its output at a ground level. While the timer 55 measures the other fixed period of time, the latch circuit 57 continues to furnish the previously latched, held output as the output signal 51 of the voltage checking circuit.

As previously mentioned, in accordance with the fourth embodiment of the present invention, since the voltage checking circuit 5 can bring the N-channel transistor 532 of the second unit 53 into the off state when the voltage checking circuit 5 does not need to perform the voltage checking operation, it can reduce the current consumption due to the through current flowing through the second unit 53. In addition, since the voltage checking circuit 5 can perform the voltage checking operation at predetermined intervals, it can further reduce the current consumption due to the through current flowing through the second unit 53.

The structure of the first unit 52 of the voltage checking circuit 5 is not limited to the one as shown in FIG. 8. The first unit 52 of the voltage checking circuit 5 can have any structure if it can bring the N-channel transistor 532 of the second unit 53 into the off state when the voltage checking circuit 5 does not need to perform the voltage checking operation.

Many widely different embodiments of the present invention may be constructed without departing from the spirit and scope of the present invention. It should be understood that the present invention is not limited to the specific embodiments described in the specification, except as defined in the appended claims.

What is claimed is:

1. Power supply voltage step-down circuitry comprising:

first voltage step-down means for generating a first voltage from a power supply, the first voltage having a value less than that of a voltage generated by said power supply, and for controlling the value of said first voltage by comparing said first voltage with a reference voltage, to supply said first voltage to a receiver;

second voltage step-down means for generating a second voltage from said power supply, the second voltage having a value less than that of the voltage generated by said power supply, and for supplying said second voltage to said receiver;

control means for enabling either said first voltage step-down means or said second voltage step-down means according to a control signal applied thereto;

voltage checking means for checking whether or not the value of the voltage generated by said power supply is equal to or greater than a predetermined value, and for furnishing a checking result signal at a predetermined level when the value of the voltage generated by said power supply is equal to or greater than the predetermined value;

switching means for connecting either said power supply or an output of said first step-down means with said receiver according to whether or not said checking result signal from said voltage checking means is at the predetermined level; and said voltage checking means including a Schmidt circuit provided with checking means for furnishing an output having a value corresponding to the value of the voltage of said power supply, a first inverter for receiving and inverting the output of said checking means, a second inverter having an input connected to an output of said first inverter and an output connected to an input of said first inverter, and a third inverter that has an input connected to the output of said first inverter and inverts the output of said first inverter, said Schmidt circuit furnishing the checking result signal at a level corresponding to the value of the output of said checking means.

2. The power supply voltage step-down circuitry according to claim 1, wherein said checking means of said voltage checking means is enabled only when said control means furnishes an output having a predetermined value so as to enable either said first voltage step-down means or said second voltage step-down means.

3. The power supply voltage step-down circuitry according to claim 2, wherein said checking means includes at least a resistor, and a transistor having a first terminal connected to said power supply by way of said resistor, a second terminal connected to a ground, and a gate terminal connected to the output of said control means.

4. The power supply voltage step-down circuitry according to claim 3, wherein said checking means furnishes an output to said Schmidt circuit by way of a connecting point between said resistor and said first terminal of said transistor.

5. The power supply voltage step-down circuitry according to claim 3, wherein said checking means includes two resistors in series, and furnishes an output to said Schmidt circuit by way of a connecting point between said two resistors.

6. The power supply voltage step-down circuitry according to claim 2, wherein said voltage checking means includes a timer means for allowing said control means to furnish its output to said checking means at predetermined intervals, and a latch circuit for latching and holding an output of said Schmidt circuit at said predetermined intervals, and for furnishing the latched output of said Schmidt circuit as said checking result signal.

7. The power supply voltage step-down circuitry according to claim 3, wherein said voltage checking means includes a timer means for allowing said control means to furnish its output to said checking means at predetermined intervals, and a latch circuit for latching and holding an output of said Schmidt circuit at said predetermined intervals, and for furnishing the latched output of said Schmidt circuit as said checking result signal.

8. The power supply voltage step-down circuitry according to claim 4, wherein said voltage checking means includes a timer means for allowing said control means to furnish its output to said checking means at predetermined intervals, and a latch circuit for latching and holding an output of said Schmidt circuit at said predetermined intervals, and for furnishing the latched output of said Schmidt circuit as said checking result signal.

9. The power supply voltage step-down circuitry according to claim 5, wherein said voltage checking means includes a timer means for allowing said control means to furnish its output to said checking means at predetermined intervals, and a latch circuit for latching and holding an output of said Schmidt circuit at said predetermined intervals, and for furnishing the latched output of said Schmidt circuit as said checking result signal.

10. The power supply voltage step-down circuitry according to claim 2, wherein said switching means connects the output of said first step-down means with said receiver when said checking result signal from said voltage checking means is at the predetermined level, or directly connects said power supply with said receiver otherwise.

* * * * *